US005717291A

United States Patent [19]

Kim

[11] Patent Number: 5,717,291

[45] Date of Patent: Feb. 10, 1998

[54] PLASMA DISPLAY PANEL WITH DISCHARGE CELLS HAVING MULTIPLE OPENINGS

[75] Inventor: Dae-il Kim, Suwon, Rep. of Korea

[73] Assignee: Samsung Display Devices Co., Ltd., Kyungki-do, Rep. of Korea

[21] Appl. No.: 556,404

[22] Filed: Nov. 13, 1995

[30] Foreign Application Priority Data

Nov. 23, 1994 [KR] Rep. of Korea ..... 94-30933

[51] Int. Cl.[6] ..... H01J 17/49

[52] U.S. Cl. ..... 313/582; 313/584; 313/585; 313/586

[58] Field of Search ..... 313/484, 485, 313/582, 583, 584, 585, 586, 631, 632

[56] References Cited

U.S. PATENT DOCUMENTS

| | | | |
|---|---|---|---|
| 4,999,541 | 3/1991 | Kim et al. | 313/584 |
| 5,001,392 | 3/1991 | Lee et al. | 313/584 |
| 5,093,603 | 3/1992 | Kim et al. | 313/584 |
| 5,138,225 | 8/1992 | Kim | 313/584 |
| 5,144,200 | 9/1992 | Kim | 313/584 |
| 5,221,979 | 6/1993 | Kim | 359/54 |
| 5,229,685 | 7/1993 | Kim et al. | 313/484 |
| 5,260,624 | 11/1993 | Kim et al. | 313/485 |
| 5,315,213 | 5/1994 | Kim | 315/169.1 |
| 5,317,231 | 5/1994 | Lee | 313/493 |
| 5,331,252 | 7/1994 | Kim | 313/584 X |
| 5,332,949 | 7/1994 | Kim | 315/169.4 |
| 5,369,338 | 11/1994 | Kim | 315/169.4 |
| 5,383,040 | 1/1995 | Kim | 359/54 |
| 5,384,514 | 1/1995 | Kim | 313/585 |
| 5,396,149 | 3/1995 | Kwon | 313/486 |
| 5,408,226 | 4/1995 | Kwon | 345/60 |

FOREIGN PATENT DOCUMENTS

| | | | |
|---|---|---|---|
| 0134451 | 10/1981 | Japan | 313/582 |
| 0055835 | 3/1988 | Japan | 313/582 |
| 0010544 | 1/1989 | Japan | 313/582 |
| 0267933 | 10/1989 | Japan | 313/582 |
| 406176699 | 6/1994 | Japan | 313/582 |

*Primary Examiner*—Sandra L. O'Shea
*Assistant Examiner*—Jay M. Patidar
*Attorney, Agent, or Firm*—Leydig, Voit & Mayer, Ltd.

[57] ABSTRACT

A structure of a DC-type plasma display panel (PDP) for lengthening the life span thereof by increasing cell impedance is provided. In the plasma display panel, two or more portions of the cathode are exposed in each discharging cell so as to increase the luminance of the concave cathode, so that the decrease of luminance according to the concave cathode structure is compensated.

5 Claims, 13 Drawing Sheets

PLASMA DISPLAY PANEL WITH DISCHARGE CELLS HAVING MULTIPLE OPENINGS

BACKGROUND OF THE INVENTION

The present invention relates to a plasma display panel, and more particularly to, a structure of a DC-type plasma display panel (PDP) for lengthening the life span thereof.

Generally, a DC electrode has a limit in its life span, and particularly, its life span is shortened if the mass and kinetic energy of positive ions colliding against a cathode is great due to the high driving voltage as in a color plasma display panel.

To solve this problem, research for new cathode material endurable against sputtering has been actively performed. However, there is no material endurable against continuous sputtering over a long period of time.

Thus, it is more desirable to research a structure endurable against sputtering without shortening of the life span than to do material endurable against the sputtering. Considering the shortening of life span by the sputtering, the sputtered particles are attached to undesired portions of a discharging cell other than the cathode, so that the driving voltage is changed to thereby lower the stability in operation.

Recently, a research for lengthening the life span of the DC-type PDP has been widely performed with respect to such new structures in various aspects. Particularly, in the NHK Broadcasting Technique Research Institute (Japan), a method of restricting discharging current by appending a resistor to each discharging cell has been adopted to lengthen the life span of the PDP. Here, the life span (L) of the PDP is expressed as the following experimental formula according to the correlation with functions affecting the life span, in consideration of the following discharging properties.

$$L \equiv P^{5-6} I^{-(2-3)} Xe(\%)$$

where L represents life span, P represents gas pressure, I represents discharging current, Xe(%) represents percentage of Xe mixed in base gas He.

First, life span is proportional to gas pressure to the roughly fifth or sixth power, since the probability of the cathode material sputtered by ions being reattached to the cathode is increased if the gas pressure is high.

Second, life span is reciprocally proportional to discharging current squared or cubed, roughly, since the number of ions colliding against the cathode increases if the the discharge current is high, so that the cathode is greatly damaged by the ions.

Third, life span is proportional to the percentage of Xe. Supposing that the discharging gas is mixture of He and Xe, the gas is ionized into $He^+$ and $Xe^+$. Here, since the mass of $Xe^+$ is greater than that of $He^+$, the momentum of $Xe^+$ applied to the cathode is greater than that of $He^+$. Thus, as the percentage of Xe increases, the probability of collision between $Xe^+$ and Xe increases, to thereby reduce the kinetic energy of ions to some extent.

As described above, in order to lengthen the life span, the current should be decreased while increasing the gas pressure and percentage of Xe. However, if the gas pressure is increased, the discharging current is increased. Thus, a method of increasing the gas pressure without the increase of the discharging current is required. That method is to append the resistor to each discharging cell. However, it is difficult to append the resistor to each discharging cell during the manufacturing process.

FIGS. 1 and 2 are a perspective view and a section view of a conventional plasma display panel, respectively. Referring to FIGS. 1 and 2, the plasma display panel comprises a front substrate 1, a rear substrate 2, a plurality of anodes 3 sequentially formed in parallel on front substrate 1, a plurality of cathodes 4 sequentially formed on rear substrate 2 perpendicular to anodes 3, a plurality of charged particle supplying electrodes 5 formed between cathodes 4 on rear substrate 2 parallel with cathodes 4, a dielectric layer 6 placed on and between cathodes 4 and charged particle supplying electrodes 5 and formed with an opening portion 4*a* exposed to the discharging space of anodes 4, for the insulation therebetween, and a latticed wall 7 for forming a discharging cell on dielectric layer 6.

As shown in FIG. 2, in the plasma display panel, cathode 4 is depressed with respect to dielectric layer 6 so that cathode material is not attached to latticed wall 7 during sputtering. This type of cathode will be hereinafter referred to as a concave structure.

In another plasma display panel without the concave structure, the sputtered cathode material is attached to the latticed wall and the dielectric layer so that the latticed wall has a function as an electrode, to thereby interrupt the effective operation of a real electrode. However, this problem has been solved by the concave plasma display panel. That is, since the electrode is sharply depressed with respect to the dielectric layer, the scattering direction of the sputtered particles can be controlled. As a result, the life span of the PDP is lengthened and an auxiliary discharging effect is increased. The above two effects have been confirmed by a real experiment, and particularly, the auxiliary discharging effect is very effective in a trigger auxiliary discharging method. That is, when the sputtered cathode material is attached to a trigger dielectric layer, the trigger discharging is weakened so that the auxiliary discharging effect is decreased. Here, the attachment of the sputtered cathode material to the dielectric layer can be prevented by adopting the concave cathode structure.

However, in the above concave cathode structure, the exposed cathode area is decreased so that the whole fluorescent layer (not shown) formed on the anode cannot be illuminated sufficiently.

SUMMARY OF THE INVENTION

To solve the above problem, it is an object of the present invention to provide a plasma display panel in which the life span of the plasma display panel, an auxiliary discharging effect, luminance, and efficiency are all increased.

To achieve the above object, there is provided a plasma display panel comprising: a front substrate; a rear substrate; a plurality of anodes formed in parallel on the front substrate; a plurality of cathodes formed on the rear substrate perpendicular to the anodes; a plurality of charged particle supplying electrodes formed in parallel between the cathodes; a dielectric layer placed on and between the cathodes and the charged particle supplying electrodes; and a latticed wall for forming a discharging cell on the dielectric layer, wherein the dielectric layer is formed with two or more opening portions through which portions of the cathodes are exposed to the discharging cell per the discharging cell.

It is preferable that the plasma display panel further comprises a sputter diffusion preventing latticed wall provided around the edge of the opening portions, on the dielectric layer.

Also, preferably, the opening portions formed per the cell may be two, three or four.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
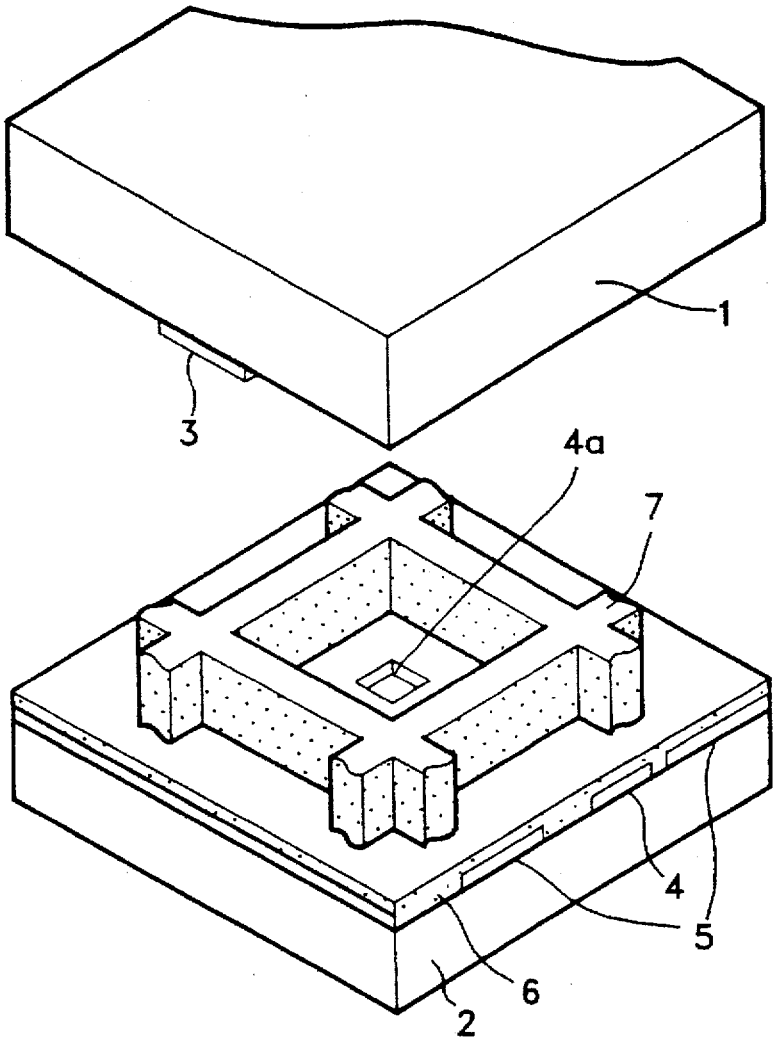
FIG. 1 PRIOR ART
FIG. 1 is a perspective view of a conventional plasma display panel.
Figure 2:
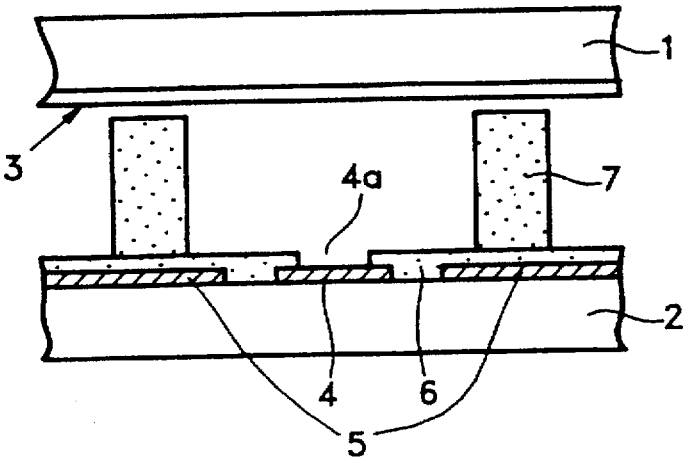
FIG. 2 PRIOR ART
FIG. 2 is a section view of the plasma display panel of FIG. 1.
Figure 3:
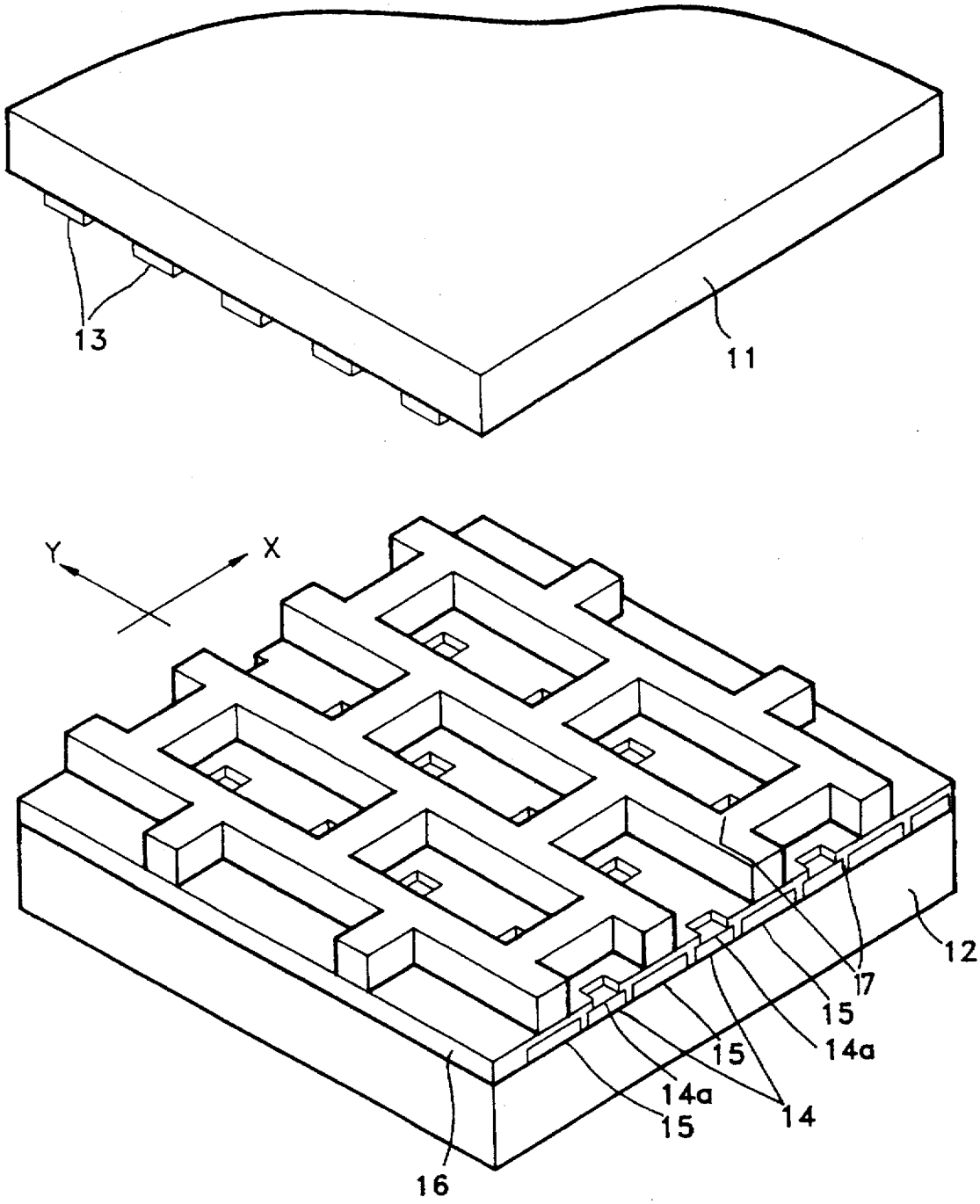
FIG. 3 is an exploded perspective view of a plasma display panel according to a preferred embodiment of the present invention.
Figure 4:
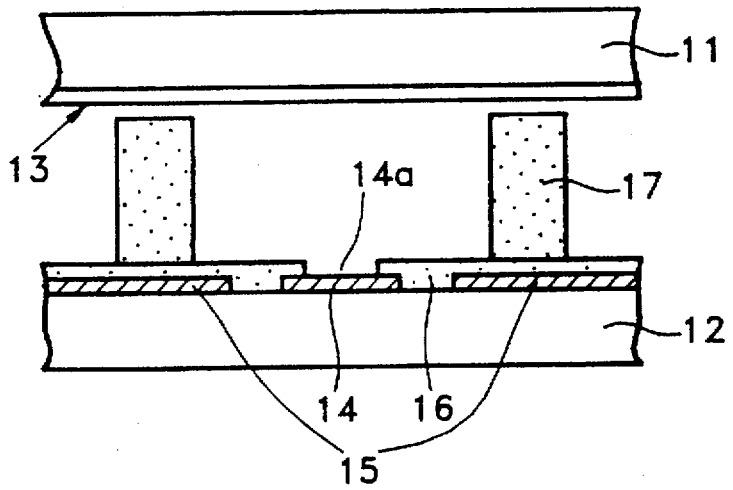
FIG. 4 is a section view of the plasma display panel of FIG. 3, cut along direction X.
Figure 5A:
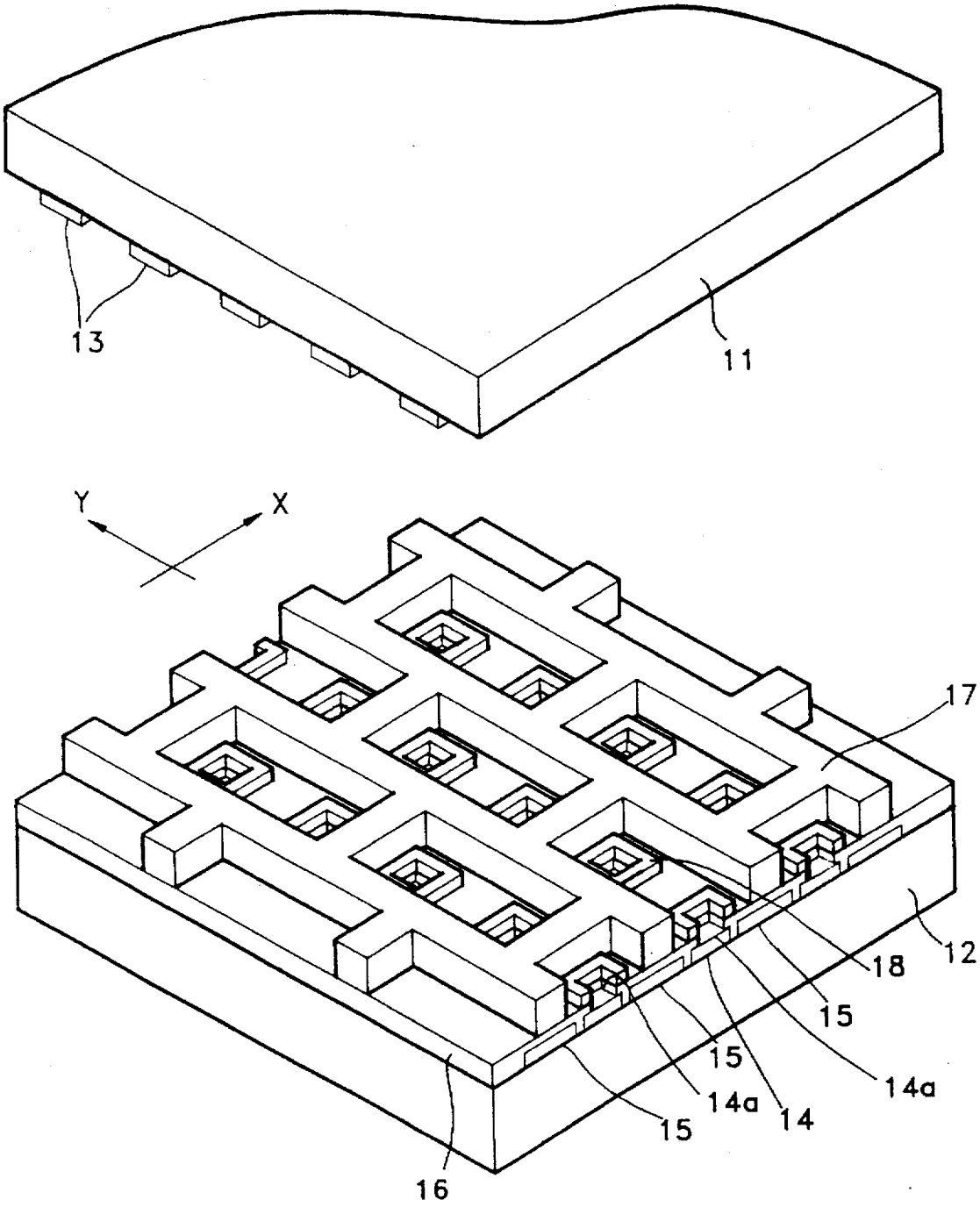
FIGS. 5A, 5B, and 5C are exploded perspective views of plasma display panels according to other preferred embodiments of the present invention.
Figure 5B:
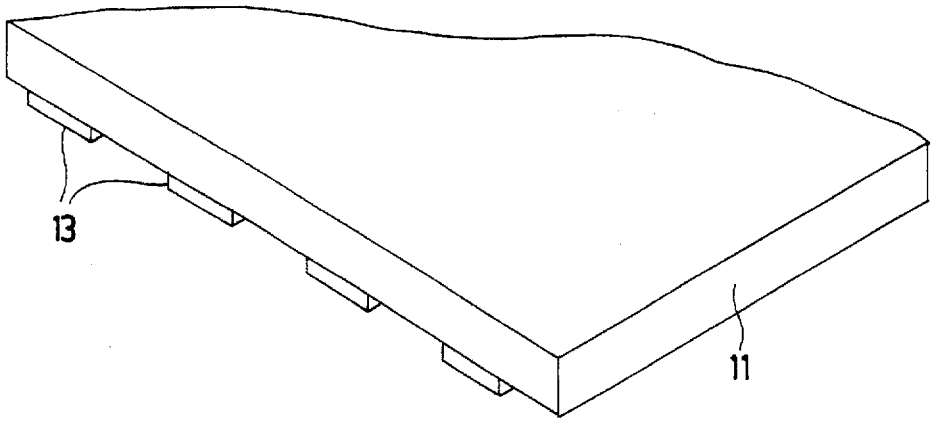
Figure 5B:
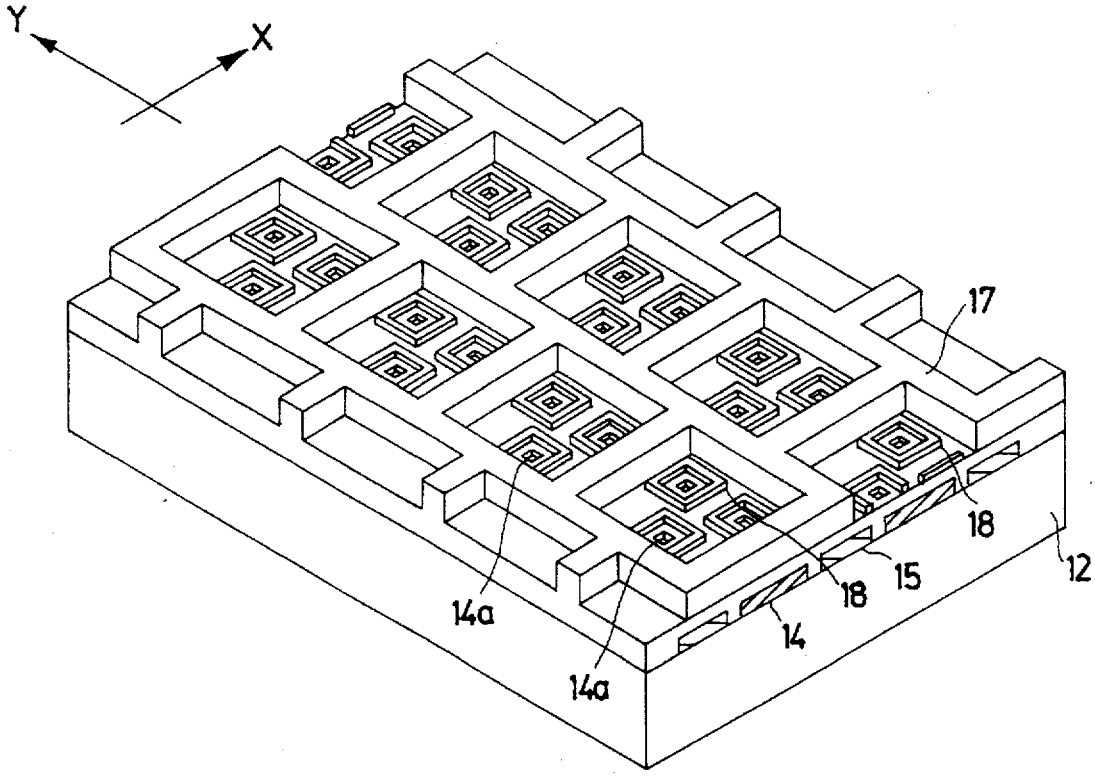
Figure 5C:
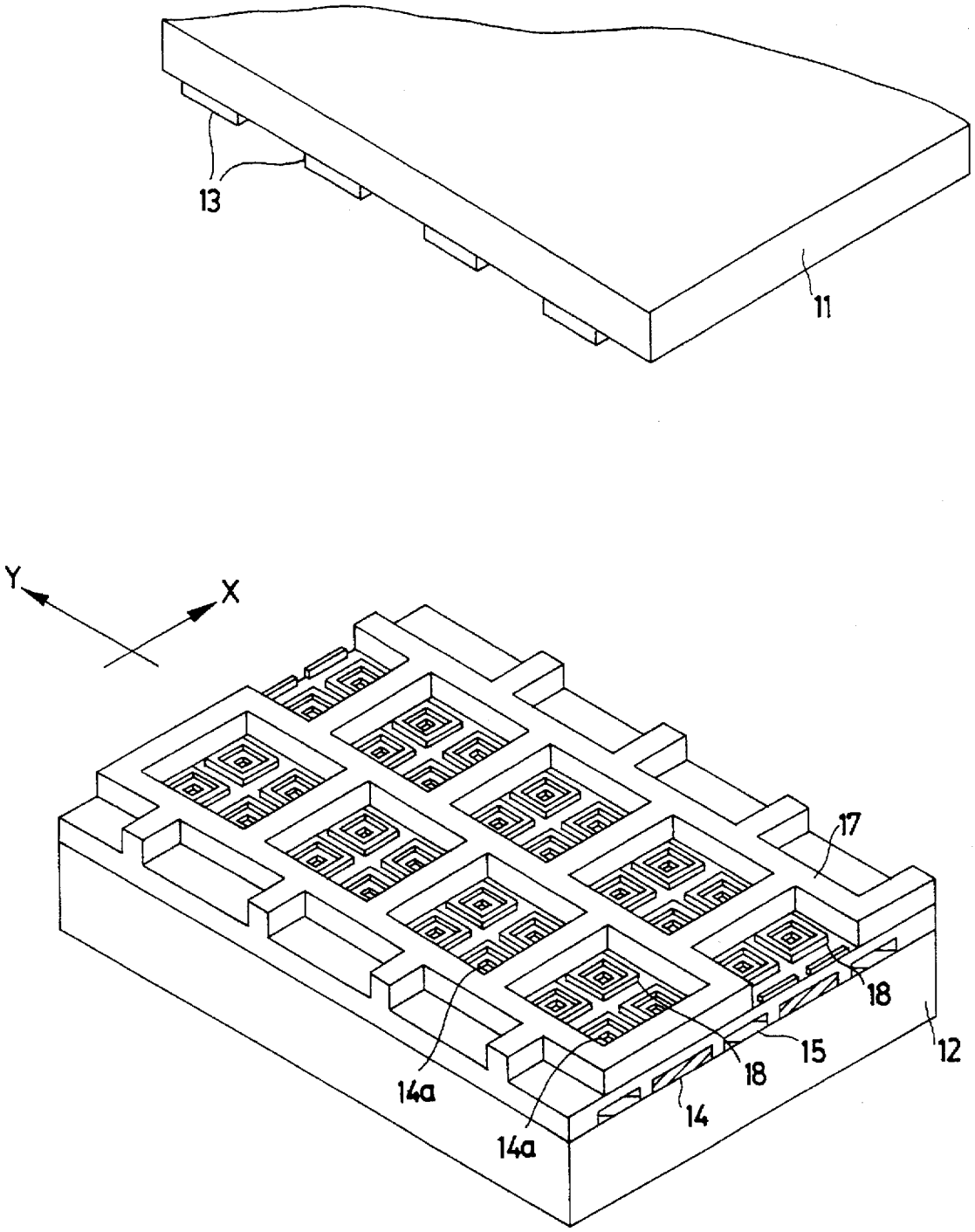

A plasma display panel according to a preferred embodiment of the present invention has a structure shown in FIGS. 3 and 4.

That is, in the plasma display panel, a front substrate 11 opposes a rear substrate 12 with a predetermined gap. A plurality of anodes 13 are formed in parallel on front substrate 11 and a plurality of cathodes 14 are sequentially formed on rear substrate 12 perpendicular to anodes 13. Also, a plurality of charged particle supplying electrodes 15 are formed between cathodes 14 on rear substrate 12 parallel with cathodes 14. A dielectric layer 16 for insulation is placed on and between cathodes 14 and charged particle supplying electrodes 15. A latticed wall 17 is formed on dielectric layer 16. As depicted in FIG. 3, the lattice wall 17, the dielectric layer 16 and the front substrate 11 define a plurality of discharging cells. Each discharging cell includes a portion of the dielectric layer having 2, 3, 4, or more openings.

Figure 6:
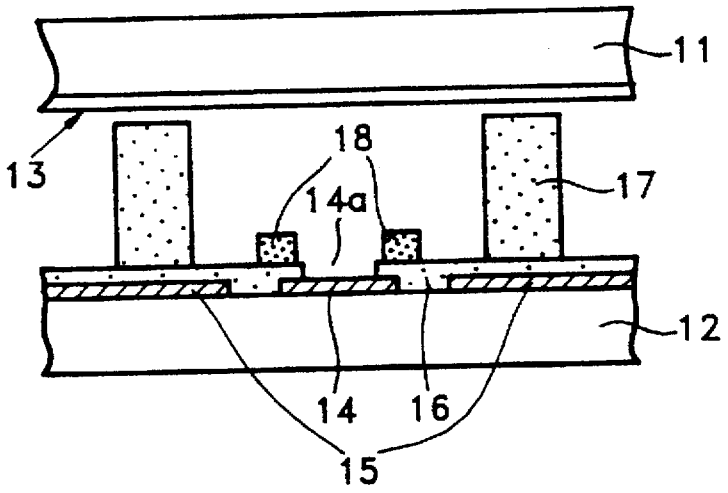
FIG. 6 is a section view of the plasma display panel of FIG. 5A, cut along direction X.
Figure 7A:
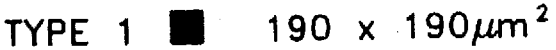
FIG. 7A (PRIOR ART)
FIGS. 7A to 7D are plane views showing various examples of the cathode of the conventional plasma display panel.
Figure 7B:
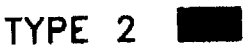
FIG. 7B (PRIOR ART)
Figure 7C:
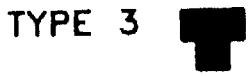
FIG. 7C (PRIOR ART)
Figure 7D:
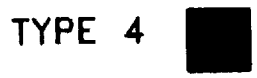
FIG. 7D (PRIOR ART)

On the other hand, as shown in FIGS. 5 and 6, a plasma display panel according to another preferred embodiment of the present invention further comprises a sputter diffusion preventing latticed wall 18 for preventing cathode material sputtered from the cathodes from being deposited to latticed wall 17, with respect to each opening portion 14*a*.

Figure 10:
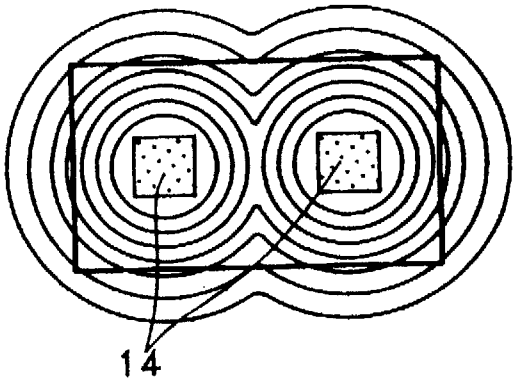
FIG. 10 is a contour diagram showing the radiation intensity of the ultraviolet rays of the cathode types used in FIGS. 3 and 5A–C.
Figure 9:
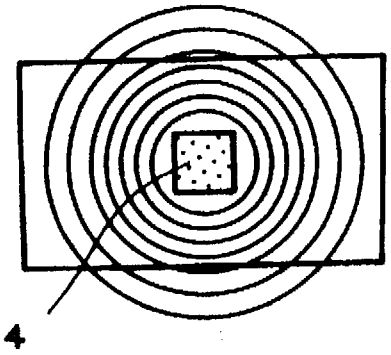
FIG. 9 (PRIOR ART)
FIG. 9 is a contour diagram showing the radiation intensity of the ultraviolet rays of the cathode type used in FIG. 1.

As described above, since the cathode is exposed through the two or more opening portions in each discharging cell, radiation intensity of the ultraviolet rays becomes strong, to thereby increase luminance over the whole fluorescent surface, as compared with the conventional plasma display panel in which the cathode is exposed through only one opening portion, as shown in FIG. 9. Here, measuring the brightness of each emitting portion by operating the conventional and present plasma display panels, the emitting portions become dark gradually from the center toward the border, which are expressed as contour lines in FIGS. 9 and 10, since the border is far from the cathodes by which the ultraviolet rays are generated.

Figure 8A:
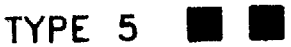
FIGS. 8A to 8C are plane views showing various examples of the cathode of the plasma display panel according to the present invention.
Figure 8B:
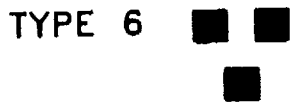
Figure 8C:
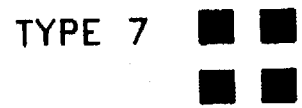

To confirm this, the plasma display panel is operated by changing the area of the opening portion of the cathodes, to obtain cell voltage-versus-current and brightness-versus-power plots. Here, the types of cathode adopted in this experiment are shown in FIGS. 7A to 7D with respect to the conventional PDP and FIGS. 8A to 8C with respect to the PDP according to the present invention. That is, in FIGS. 7A to 7D, type 1 has a basic exposed area in the conventional PDP and types 2, 3 and 4 are obtained by combining type 1 in groups of two, three and four, respectively. In FIGS. 8A to 8C, types 5, 6 and 7 are examples of the PDP according to the present invention obtained by separately arranging type 1 shown in FIG. 7A in groups of two, three and four, respectively.

Figure 11:
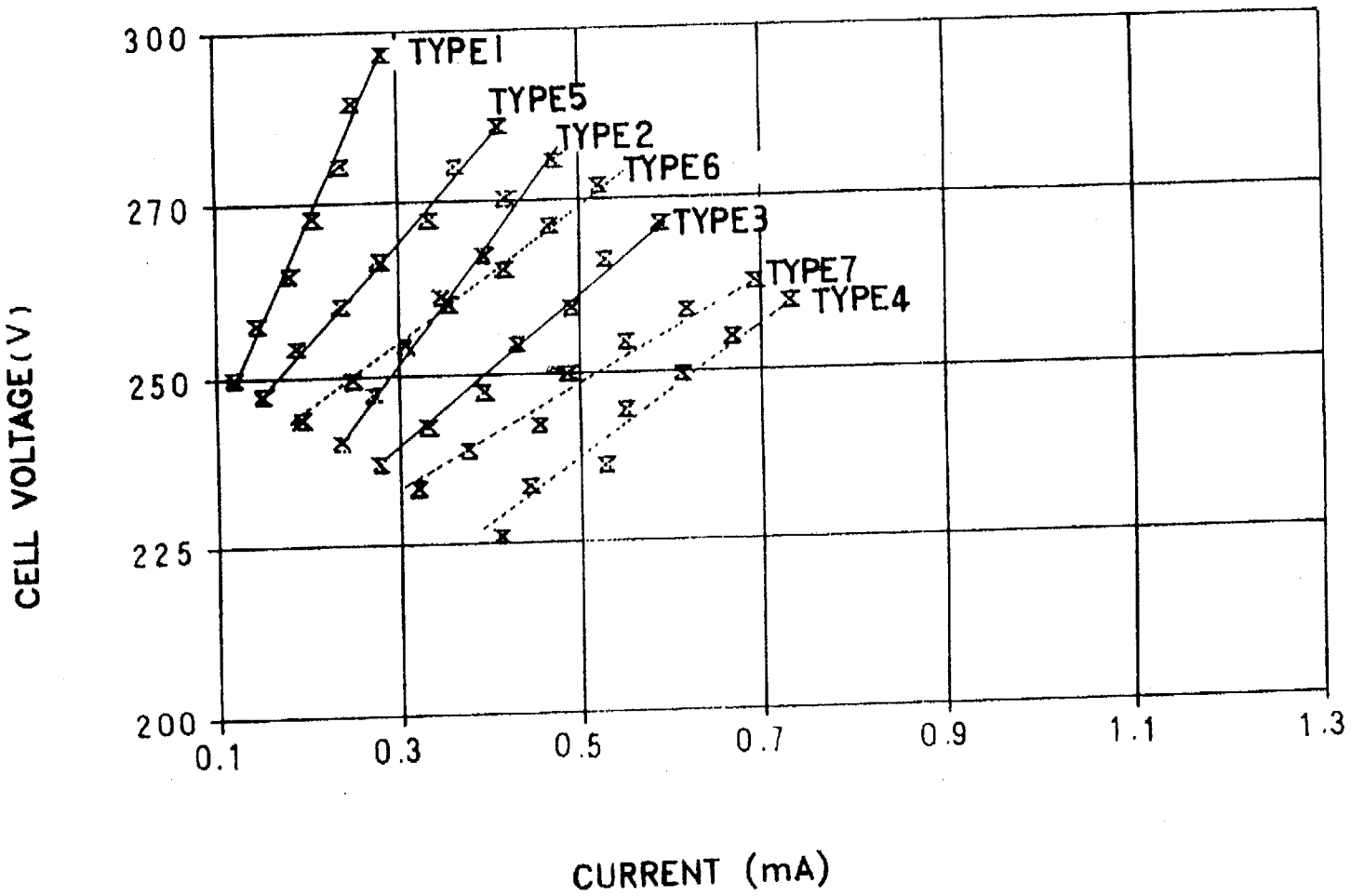
FIG. 11 is a graph showing cell voltage versus current of the plasma display panel employing cathodes shown in FIGS. 7A to 7D and 8A to 8C under 250 Torr gas pressure and 3% Xe (He base)
Figure 12:
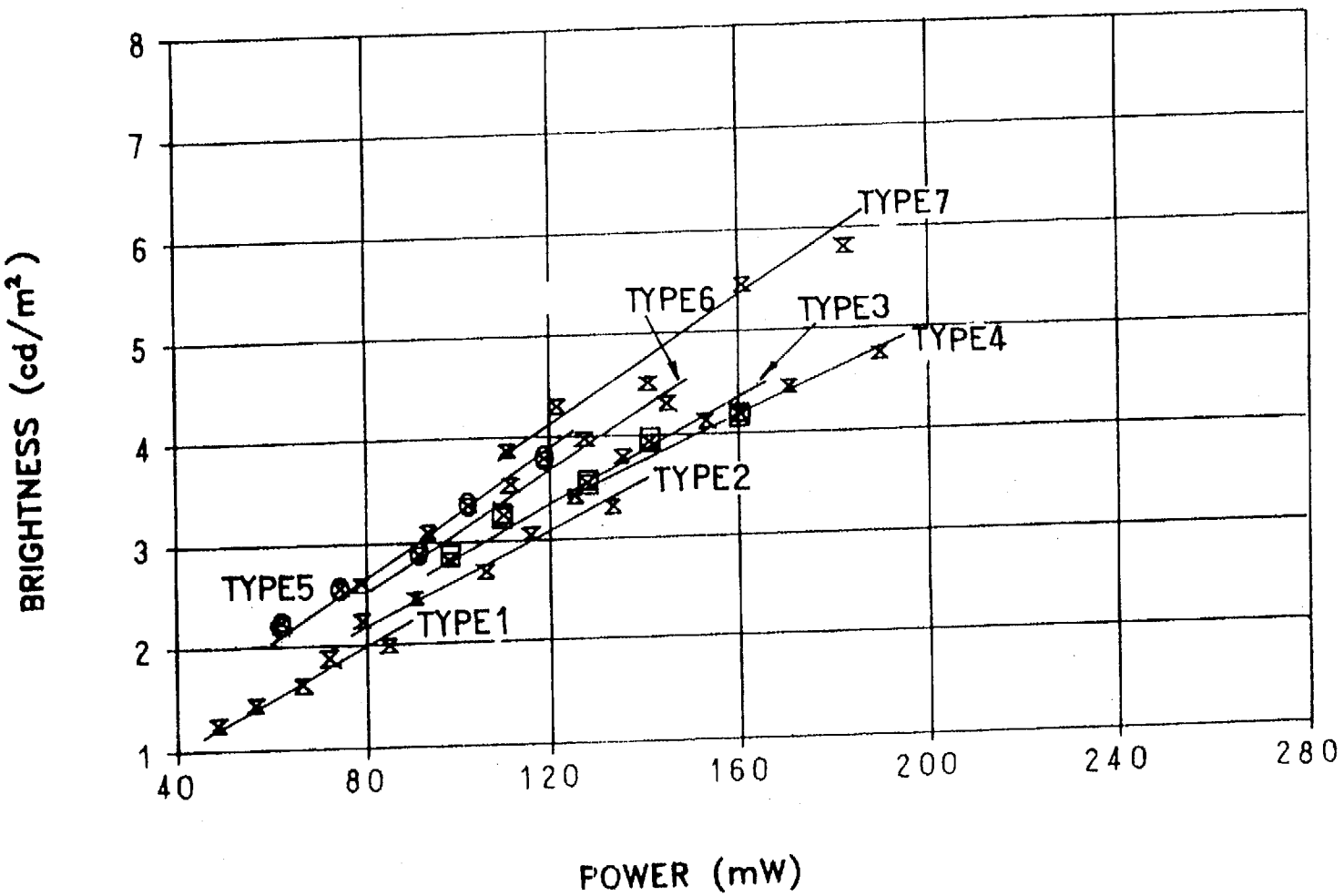
FIG. 12 is a graph showing brightness versus power in a cell of the plasma display panel employing cathodes shown in FIGS. 7A to 7D and 8A to 8C under 250 Torr gas pressure and 3% Xe (He base)
Figure 13:
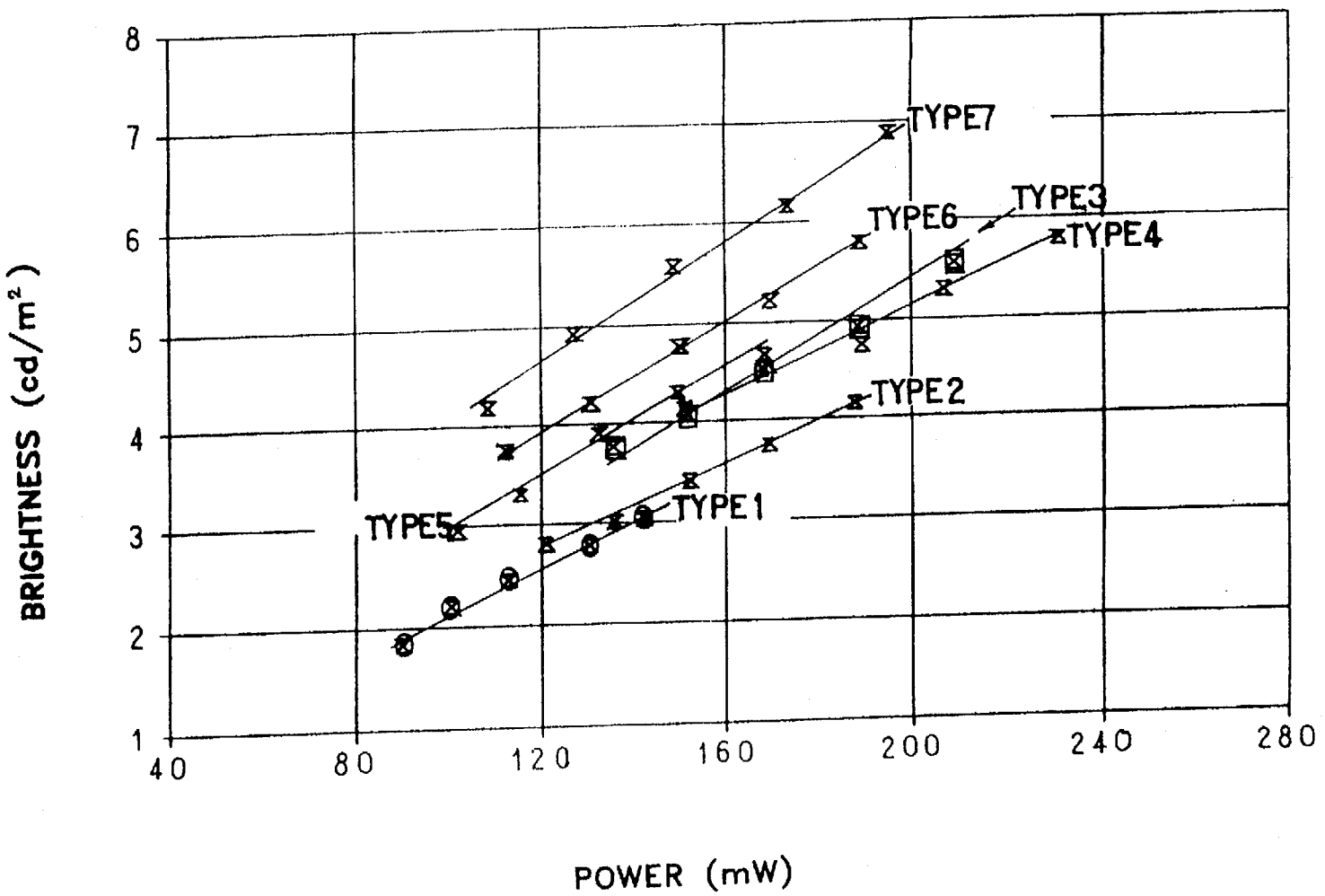
FIG. 13 is a graph showing brightness versus power in a cell plasma display panel employing cathodes shown in FIGS. 7A to 7D and 8A to 8C under 300 Torr gas pressure and 3% Xe (He base)
Figure 14:
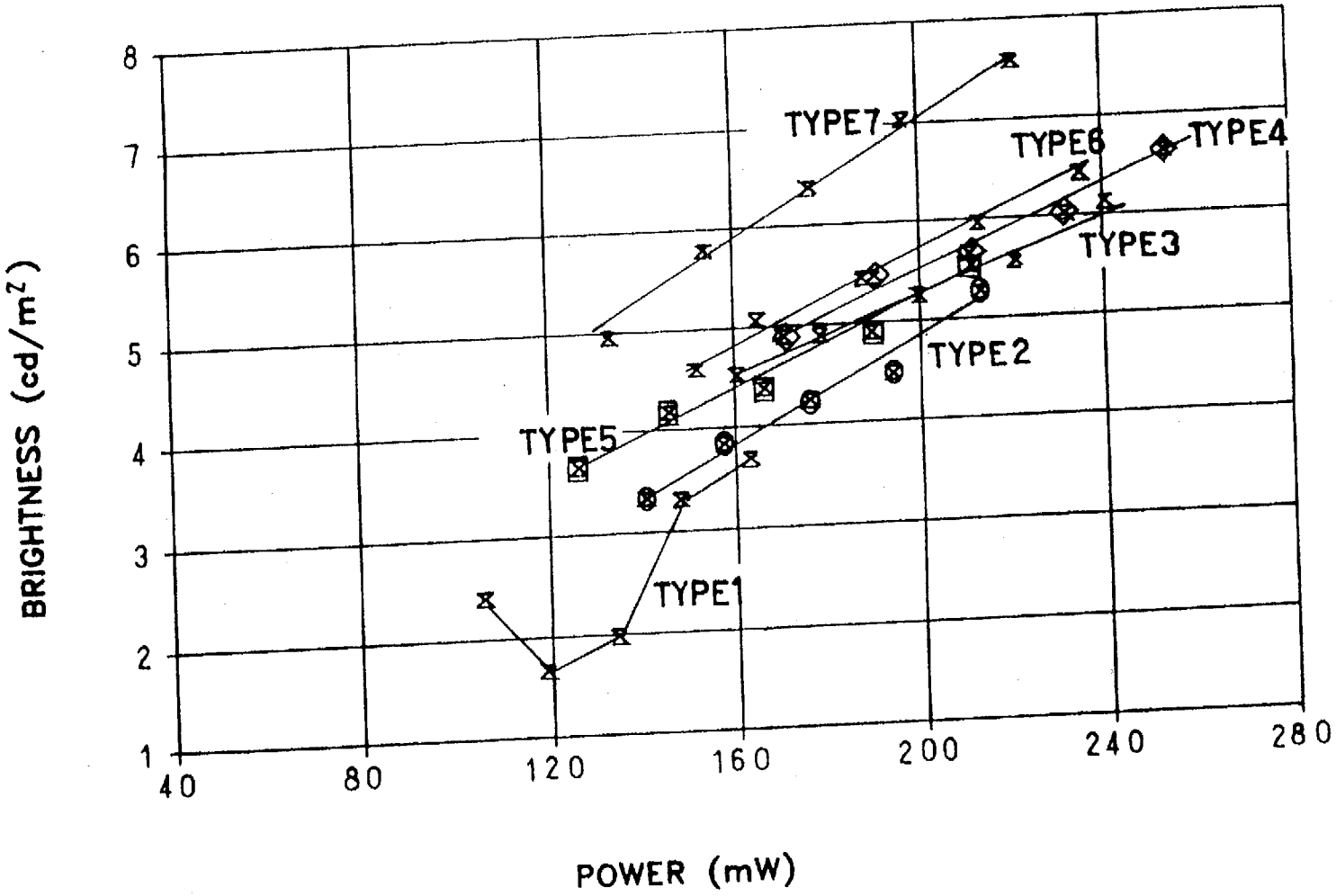
FIG. 14 is a graph showing brightness versus power in a cell of the plasma display panel employing cathodes shown in FIGS. 7A to 7D and 8A to 8C under 350 Torr gas pressure and 3% Xe (He base).

FIG. 11 is a graph showing cell voltage versus current of the plasma display panel employing cathodes shown in FIGS. 7A to 7D and 8A to 8C under 250 Torr gas pressure and 3% Xe (He base), FIG. 12 is a graph showing brightness versus power in a cell of the plasma display panel employing cathodes shown in FIGS. 7A to 7D and 8A to 8C under 250 Torr gas pressure and 3% Xe (He base), FIG. 13 is a graph showing brightness versus power in a cell of the plasma display panel employing cathodes shown in FIGS. 7A to 7D and 8A to 8C under 300 Torr gas pressure and 3% Xe (He base), and FIG. 14 is a graph showing brightness versus power in a cell of the plasma display panel employing cathodes shown in FIGS. 7A to 7D and 8A to 8C under 350 Torr gas pressure and 3% Xe (He base).

As can be seen in the above graphs, first, the impedance of a discharging cell (as a voltage-versus-current characteristic) increases as the exposed area of the cathode is narrow and opening portions of the cathode are separated from each other. That is, the cathode impedance is lowered in type 1, type 2 and type 3, gradually. Also, the impedance of type 5 is greater than that of type 2, the impedance of type 6 is greater than that of type 3, and the impedance of type 7 is greater than that of type 4.

Second, the luminance is nearly the same in type 1, type 2, type 3 and type 4, and is higher when a plurality of opening portions are separated from each other, as in type 5, type 6 ,and type 7.

As described above, in the plasma display panel according to the present invention, two or more portions of the cathode are exposed in each discharging cell so as to increase the luminance of the cathode of the concave structure. In addition, the impedance of the cell itself is increased so that the life span of the panel is lengthened.

What is claimed is:

1. A plasma display panel comprising:

a front substrate;

a rear substrate;

a plurality of anodes formed in parallel on said front substrate;

a plurality of cathodes formed on said rear substrate perpendicular to said anodes;

a plurality of charged particle supplying electrodes formed in parallel between said cathodes;

a dielectric layer placed on and between said cathodes and said charged particle supplying electrodes; and a latticed wall for forming a discharging cell on said dielectric layer, wherein a portion of the dielectric layer disposed within the discharging cell is includes at least two openings through which portions of said cathodes are exposed to the discharging cell.

2. A plasma display panel as claimed in claim 1, wherein each unit cell includes a portion of the dielectric layer and the portion of the dielectric layer includes first and second openings.

3. A plasma display panel as claimed in claim 1, wherein each unit cell includes a portion of the dielectric layer and the portion of the dielectric layer includes first, second, and third openings.

4. A plasma display panel as claimed in claim 1, wherein each unit cell includes a portion of the dielectric layer and the portion of the dielectric layer includes first, second, third, and fourth openings.

5. A plasma display panel comprising:

a front substrate;

a rear substrate;

a plurality of anodes formed in parallel on said front substrate;

a plurality of cathodes formed on said rear substrate perpendicular to said anodes;

a plurality of charged particle supplying electrodes formed in parallel between said cathodes;

a dielectric layer placed on and between said cathodes and said charged particle supplying electrodes;

a latticed wall for forming a discharging cell on said dielectric layer, wherein a portion of the dielectric layer disposed within the discharging cell includes at least two openings through which portions of said cathodes are exposed to the discharging cell; and a sputter diffusion preventing latticed wall provided around the edge of the opening portions on said dielectric layer.

* * * * *